US005737435A

United States Patent [19]

De Poortere et al.

[11] Patent Number: 5,737,435

[45] Date of Patent: Apr. 7, 1998

[54] SOUND-REPRODUCING APPARATUS COMPRISING AN ACOUSTIC HORN, AND ACOUSTIC HORN FOR USE IN THE APPARATUS

[75] Inventors: Gerrit F. M. De Poortere, Sint Niklaas, Belgium; Martinus P. M. Van De Thillart, Eindhoven, Netherlands; Guido O. M. D'Hoogh, Dendermonde, Belgium; Joris A. M. Nieuwendijk, Eindhoven, Netherlands

[73] Assignee: U.S. Philips Corporation, New York, N.Y.

[21] Appl. No.: 576,625

[22] Filed: Dec. 21, 1995

[30] Foreign Application Priority Data

Dec. 23, 1994 [EP] European Pat. Off. ..... 94203746

[51] Int. Cl.[6] ..... H04R 25/00

[52] U.S. Cl. ..... 381/156; 381/188; 181/151; 181/152

[58] Field of Search ..... 381/194, 199, 381/205, 156, 188; 181/151, 152, 159, 177

[56] References Cited

U.S. PATENT DOCUMENTS

| | | | |
|---|---|---|---|
| 2,440,078 | 8/1948 | Devine | 181/31 |
| 2,642,948 | 6/1953 | Olson et al. | 181/31 |
| 4,199,657 | 4/1980 | Lane | 181/145 |
| 4,496,021 | 1/1985 | Berlant | 181/152 |
| 5,315,663 | 5/1994 | Thiele | 381/205 |
| 5,471,018 | 11/1995 | Nieuwendijk et al. | 181/152 |

FOREIGN PATENT DOCUMENTS

| | | | |
|---|---|---|---|
| 0451885A1 | 10/1991 | European Pat. Off. | H04R 1/34 |
| 0295398 | 12/1990 | Japan | 381/199 |

*Primary Examiner*—Curtis Kuntz
*Assistant Examiner*—Rexford Barnie
*Attorney, Agent, or Firm*—Robert M. McDermott

[57] ABSTRACT

A sound-reproducing apparatus comprises an acoustic horn which terminates in an opening in the wall of the apparatus. An obstacle is arranged in the acoustic duct of the horn, which provides a better frequency response.

9 Claims, 3 Drawing Sheets

SOUND-REPRODUCING APPARATUS COMPRISING AN ACOUSTIC HORN, AND ACOUSTIC HORN FOR USE IN THE APPARATUS

BACKGROUND OF THE INVENTION

1. Field of the Invention

The invention relates to an apparatus for the reproduction of sound, comprising a housing which accommodates an acoustic horn, which horn has an acoustic duct having a length, which duct is bounded by a horn side wall and terminates in an opening in a side wall of the housing, which horn side wall is partly formed by a diaphragm which is drivable by a drive mechanism.

The invention also relates to an acoustic horn for use in the apparatus defined above.

2. Discussion of the Related Art

Such an apparatus and such an acoustic horn are known from U.S. Pat. No. 5,471,018. The known apparatus is a car radio or a television receiver which incorporates an acoustic horn which terminates in an opening in the front of the apparatus. The acoustic horn is formed by a cone loudspeaker and an injection-moulding, which together form an acoustic horn. The injection-moulding is adapted to the shape of the cone in such a manner that the cross-sectional area of the acoustic duct formed by the injection-moulding decreases monotonically as a function of the distance from the opening. A disadvantage of the known apparatus is that the horn construction attenuates the high-frequency reproduction of the loudspeaker. Another disadvantage of the known apparatus is that the reproduction of mid-range frequencies by the loudspeaker is boosted by resonances of the air in the acoustic horn. The above effects give rise to a non-uniform reproduction of sound for different frequencies.

SUMMARY OF THE INVENTION

It is an object of the invention to improve an apparatus of the type defined in the opening paragraph and an acoustic horn so as to obtain a more uniform high-frequency and mid-frequency reproduction.

To this end the apparatus in accordance with the invention is characterised in that an obstacle is disposed in the duct near a central part of the diaphragm, the duct having a cross-section (A—A) with an area which as a function of a distance from the opening is represented by a curve having a local minimum at the location of the obstacle. Surprisingly, it has been found that this measure improves the frequency response of the sound reproduction of the acoustic horn. Experiments have shown that particularly a fairly abrupt increase in cross-section at the location of the centre of the diaphragm yields a substantial improvement of in high-frequency reproduction.

An embodiment of the apparatus in accordance with the invention is characterised in that the obstacle is formed by a stepped profile in the horn side wall. In this way the obstacle is simple to realise. Preferably, the stepped profile is a sawtooth profile but a rectangular profile has likewise proved to give an improved frequency response. These profiles can be formed simply if the wall opposite the diaphragm is made of a plastics by means of an injection-moulding die. In such a die such a profile has to be formed only once. This enables an improved frequency response to be obtained without the production costs of the apparatus being increased.

An embodiment of the apparatus in accordance with the invention is characterised in that the obstacle is formed by at least a part of the drive mechanism. When a normal cone loudspeaker is used as in the known apparatus, the drive mechanism forms a projection on the horn. By arranging the drive mechanism in the horn duct a much flatter horn can be obtained. This enables a television receiver to be manufactured whose housing is not much wider than the picture tube in the television set, whilst the sound yet emanates from the front of the apparatus. For use in portable computers it is also very important to have an acoustic horn which is as flat as possible. This horn can then be mounted, for example, underneath the keyboard with the aperture directed towards the user. A flat construction is also of great importance for automotive uses. This enables such an acoustic horn to be mounted in a car radio, or in a door or dashboard of a car.

This embodiment can be realised very simply if the diaphragm and the drive mechanism form part of a so-called wafer loudspeaker. Wafer loudspeakers are loudspeakers in which a drive mechanism with a suspension is connected to the sound-radiating side of a conical diaphragm. The drive mechanism is then situated at the inner side of the cone, which results in a flat loudspeaker. When such a loudspeaker is used in an apparatus in accordance with the invention the loudspeaker can be manufactured and tested as a separate unit. After assembly of an acoustic horn with this loudspeaker the drive mechanism will be situated in the horn duct, which yields the advantages outlined in the above paragraph.

An embodiment of the apparatus in accordance with the invention is characterised in that the drive mechanism comprises a magnet system and a coil former, the magnet system is carried by a part of the horn side wall which faces the diaphragm, and the coil former extends in the acoustic duct between the magnet system and the diaphragm. By using the horn side wall a separate suspension for positioning the magnet system may be dispensed with. This enables the production costs of the apparatus in accordance with the invention to be reduced.

An embodiment of the apparatus in accordance with the invention is characterised in that a cone is disposed in the duct near a central part of the diaphragm, which cone is drivable by the drive mechanism. The use of a so-called double cone gives a further improvement in high-frequency reproduction.

An embodiment of the apparatus in accordance with the invention is characterised in that the area of the opening is smaller than the area of the diaphragm, and the opening is elongate. It has been found that when the opening is thus dimensioned a correct sound reproduction can be obtained with a limited area of the opening. Good results have been obtained, for example, with an opening having an aspect ratio smaller than 1:3. Thus, it is possible to obtain the quality of sound and the acoustic power of a given loudspeaker while the area required in the wall of the apparatus housing is substantially smaller than in the case that the loudspeaker is mounted in conventional manner.

An embodiment of the apparatus in accordance with the invention is characterised in that the diaphragm forms at least a quarter of the area of the horn side wall. Less coloration of the sound occurs as the diaphragm forms a larger part of the area of the horn side wall. It appears that if the diaphragm forms more than a quarter of the horn area the coloration is no longer found to be annoying.

An embodiment of the apparatus in accordance with the invention is characterised in that the apparatus comprises a picture tube near the horn, and the drive mechanism comprises a magnet system with an air gap, which air gap is situated at the side of the magnet system which is remote from the picture tube. A magnet system of a loudspeaker produces a stray field at the side of the magnet system where the air gap is situated. In the television receiver known from EP-A-451,885 a minimal width of the cabinet has been achieved by orienting the air gap of the magnet system towards the picture tube. In the apparatus in accordance with the invention, however, a minimal cabinet width can also be obtained when the air gap is directed away from the picture tube. This is advantageous because the stray field of the magnet system can affect the quality of the picture displayed by the picture tube.

BRIEF DESCRIPTION OF THE DRAWINGS

The invention will now be described in more detail, by way of example, with reference to the drawings, in which.

It is to be noted that the embodiments are shown diagrammatically and the Figures are shown to an arbitrary scale, which is not always the same.

DETAILED DESCRIPTION OF THE PREFERRED EMBODIMENTS

Figure 1:
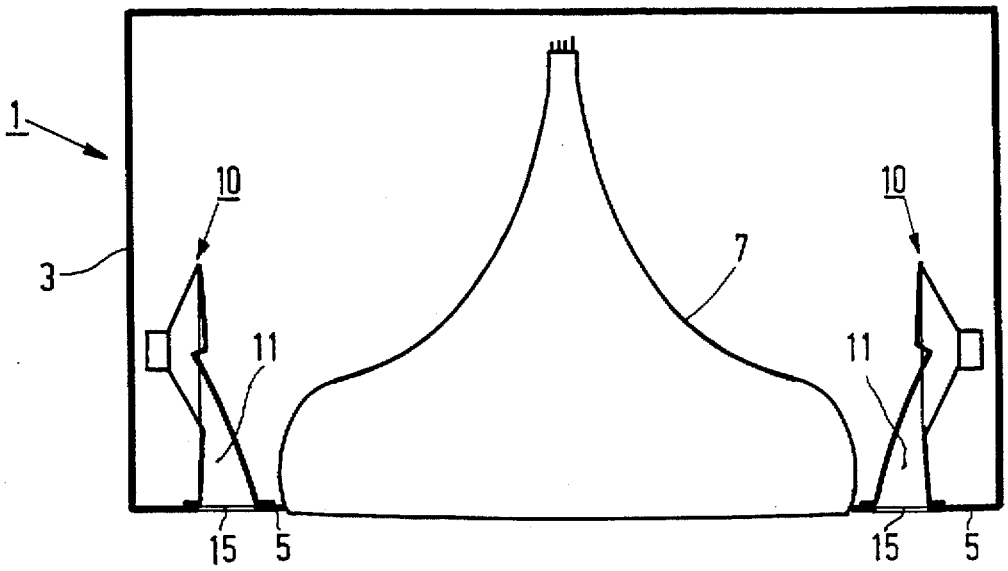
FIG. 1 is a sectional view showing an embodiment of the apparatus in accordance with the invention.

FIG. 1 shows an apparatus in accordance with the invention, in the present case a television receiver 1 having a housing 3 which accommodates a picture tube 7 and two acoustic horns 10. The acoustic horns 10 have an acoustic duct 11 which terminates in an opening 15 in a side wall 5 of the housing 3. In this way, as is apparent from FIG. 1, loudspeakers of a considerable size can be used whilst yet a compact construction is obtained.

Figure 2:
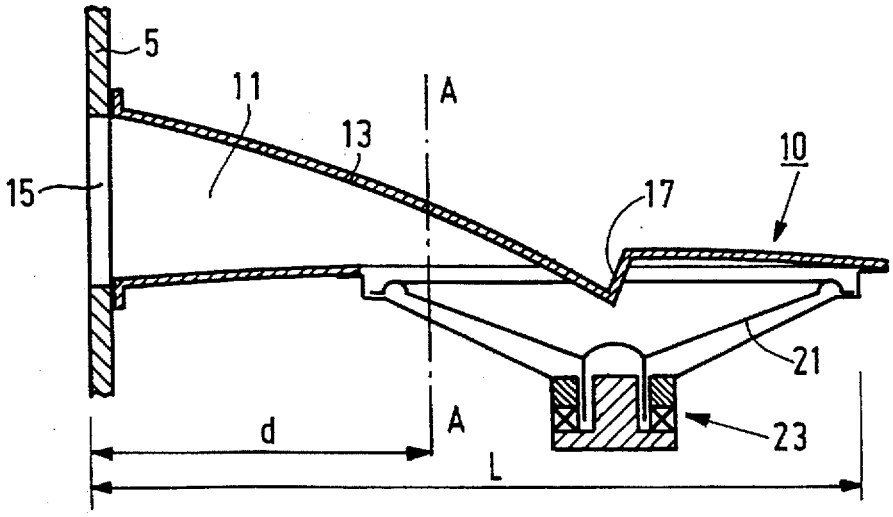
FIG. 2 is a sectional view showing a first embodiment of an acoustic horn for use in the apparatus in accordance with the invention.

FIG. 2 shows a pan of the apparatus 1 in which the side 5 of the housing 3 and a sectional view of the acoustic horn 10 are visible. The acoustic horn 10 has an acoustic duct 11 of a given length L, which duct 11 is bounded by a horn side wall 13 which extends in the longitudinal direction. The acoustic duct 11 terminates in an opening 15 in a side wall 5 of the housing 3. The horn side wall 13 is partly formed by a diaphragm 21 which extends in the longitudinal direction and which can be driven by a drive mechanism 23. An obstacle 17 is disposed in the duct 11 near a central part of the diaphragm 21. In FIG. 2 the letters A—A indicate the location of a cross-section at a distance d from the opening 15.

Figure 3:
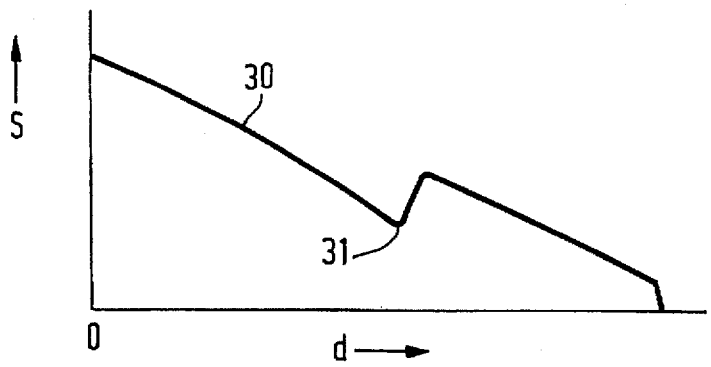
FIG. 3 is a graph the cross-sectional area of the acoustic duct as a function of the distance from the opening.

FIG. 3 shows a graph in which a curve 30 represents the cross-sectional area S at the location A—A (see FIG. 2) as a function of the distance d from the opening 15. The curve 30 descends substantially monotonically, as is customary with a horn. As a result of the obstacle 17 (see FIG. 2) the curve 30 exhibits a local minimum 31. It has been found that the provision of the obstacle 17 improves the high-frequency reproduction in comparison with that of an acoustic horn having a monotonically decreasing cross-sectional area. It has also been found that the provision of the obstacle 17 reduces the boost in the reproduction of the mid-range frequencies owing to resonances of the air in the acoustic duct 11. Satisfactory results have been obtained particularly by constructing the obstacle 17 as shown in FIG. 2. Starting from the known apparatus this improvement can be realised simply by a single modification of the die by means of which the horn side wall 13 is manufactured. This enables a substantially improvement of the sound reproduction to be obtained without any significant increase of the production costs of the apparatus 1.

Figure 4:
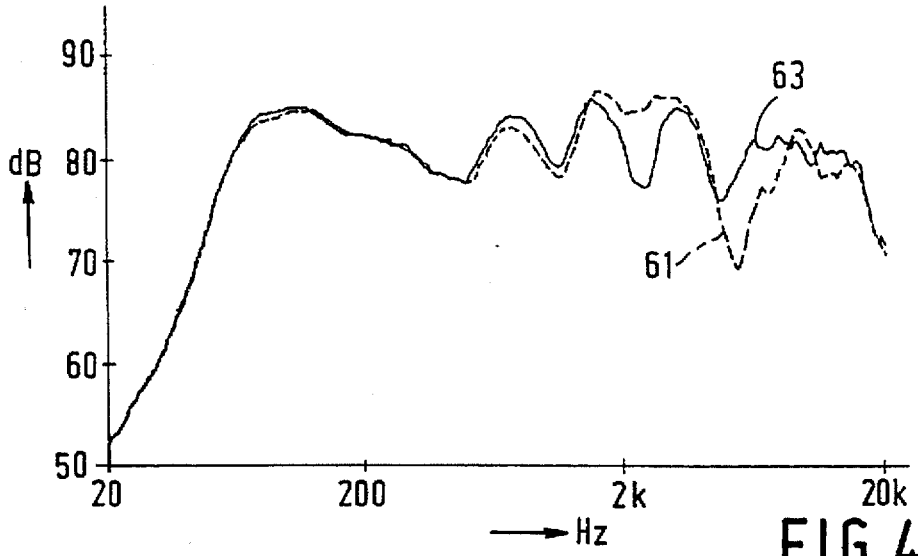
FIG. 4 shows the frequency response of the sound reproduction of the known apparatus and the apparatus in accordance with the invention.

FIG. 4 shows a graph in which the frequency response of the sound reproduction of the known apparatus is represented by a curve 61 and the frequency response of the apparatus in accordance with the invention is represented by a curve 63. The frequency is plotted logarithmically along the horizontal axis and the reproduced acoustic power is plotted logarithmically along the vertical axis. This graph shows clearly that the apparatus in accordance with the invention provides a far more uniform reproduction of the high and mid frequencies.

Figure 5:
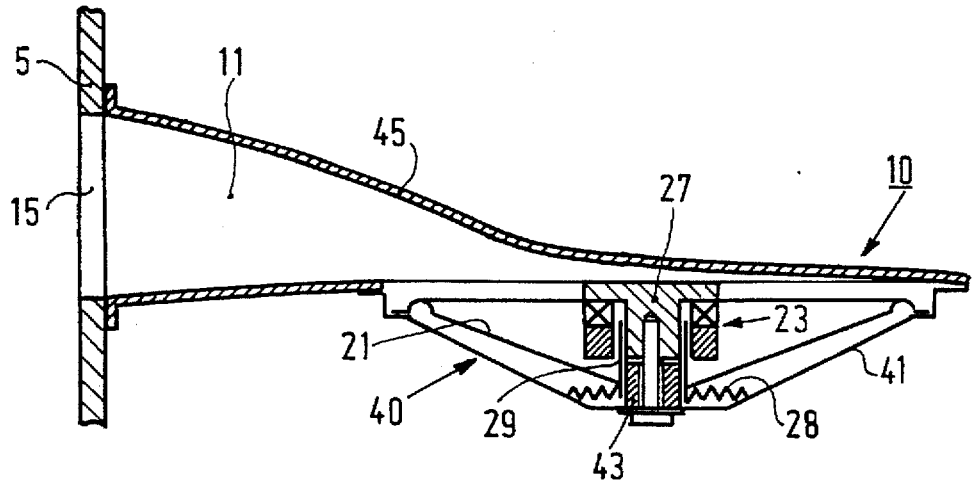
FIG. 5 is a longitudinal sectional view showing a second embodiment of an acoustic horn for use in the apparatus in accordance with the invention.

FIG. 5 is a longitudinal sectional view showing an acoustic horn suitable for use in an embodiment of the apparatus in accordance with the invention. The acoustic horn 10 shown here comprises an injection-moulding 45 and a so-called wafer loudspeaker 40. The wafer loudspeaker 40 comprises a chassis 41 in which a conical diaphragm 21 is suspended and to which a drive mechanism 23 is secured. The drive mechanism 23 is situated at the inner side of the cone 21, so that the wafer loudspeaker 40 constitutes a very flat unit. The drive mechanism 23 comprises a magnet system 27, secured to the chassis 41 by means a suspension 43, and a coil former 29, connected to the diaphragm 21. The wafer loudspeaker 40 further comprises a centring diaphragm 28 which centres the coil former 29 relative to the chassis 41. The wafer loudspeaker 40 forms a unit to be manufactured and tested separately. This has the advantage that any production faults can be detected already in an early stage. After the loudspeaker 40 has been mounted onto the injection-moulding 45 an acoustic horn is obtained in whose duct 11 an obstacle is situated near a central part of the diaphragm 21, so that the cross-sectional area S at the location A—A as a function of the distance d from the opening 15 is represented by a curve 30 having a local minimum 31 at the location if the obstacle (compare FIGS. 2 and 3). In the present embodiment the obstacle is formed by the drive mechanism 23. A great advantage of this embodiment in comparison with the known apparatus is that both a better sound reproduction and a flatter horn construction can be realised. By arranging the drive mechanism 23 in the acoustic duct 11 the largest transverse dimension of the horn is reduced by the height of the magnet system 27. As a result of this flat construction this acoustic horn 10 is very suitable for use in television receivers, mounting in a car, mounting in portable computers or in other equipment such as multi-media equipment.

Figure 6:
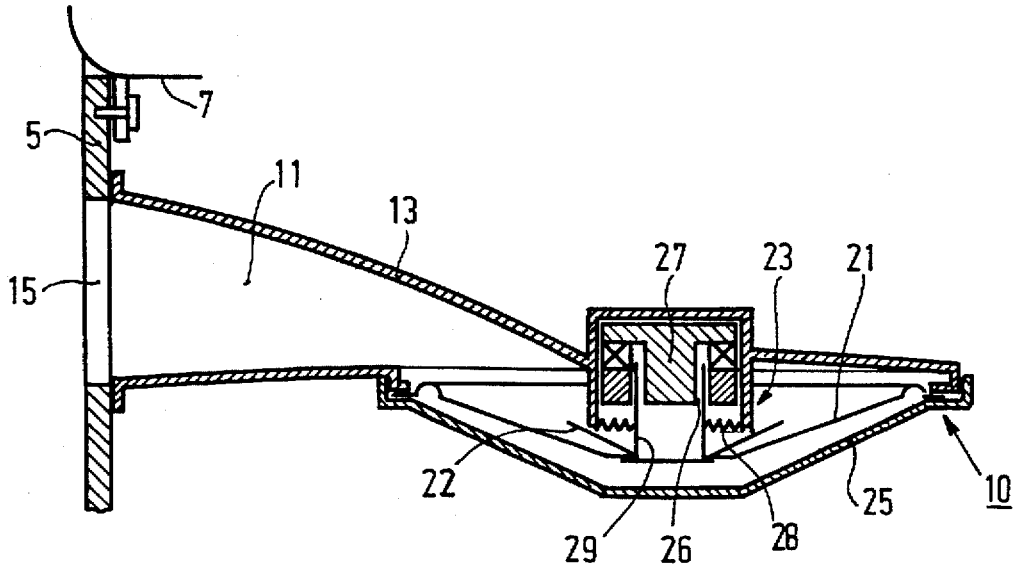
FIG. 6 is a sectional view of a part of a television receiver in accordance with the invention.

FIG. 6 is a cross-sectional view of a pan of an embodiment of an apparatus in accordance with the invention, in the present case a television receiver. The Figure shows an acoustic horn 10 and a pan of a picture tube 7. In the present embodiment, where the drive mechanism 23 comprises a magnet system 27 and a coil former 29, the magnet system is carried by a pan of the horn side wall 13 which faces the diaphragm 21. The coil former 29 extends in the acoustic duct 11 between the magnet system 27 and the diaphragm 21, to which the coil former 29 is connected. The coil former 29 is further connected to a centring diaphragm 28, which extends in the acoustic duct 11. In addition, a cone 22 is situated in the duct 11, which cone is concentrically connected to the diaphragm 21 and is driven by the drive mechanism 23. By securing the magnet system 27 to the horn side wall 13 a separate suspension (see FIG. 5) has become redundant. This enables the costs of the apparatus in accordance with the invention to be reduced. By arranging the centring diaphragm 28 in the acoustic duct 11 a simple protective cover 25 can be used instead of an accurately manufactured chassis 41 (see FIG. 5). This protective cover 25 merely serves to protect the diaphragm 21 and can therefore be a simple and cheap product of, for example, a plastics. The additional cone 22 provides a further improvement of the treble reproduction of the apparatus in accordance with the invention. In the present embodiment the magnet system 27 has an air gap 26 and the magnet system is arranged in such a manner that the air gap is situated at the side of the magnet system 27 which is remote from the picture tube 7. Such a magnet system 27 produces a magnetic stray field near the air gap 26. As a result of the proposed arrangement of the magnet system 27 the magnet system itself shields this because such a m the picture tube 7. This is advantageous because such a stray field may affect the quality of the picture displayed by the picture tube 7. It will be evident that in the present embodiment the coil former 29 and the magnet system 27 now form the obstacle described hereinbefore.

Figure 7:
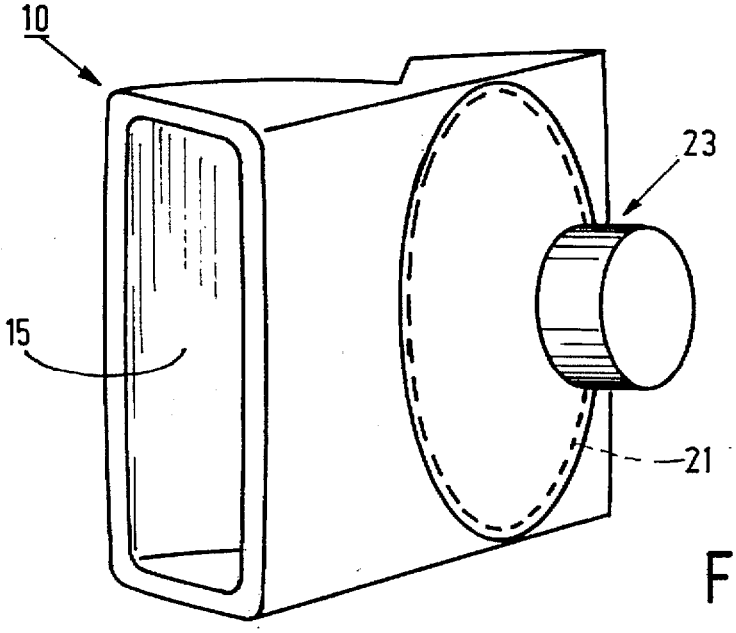
FIG. 7 is a perspective view showing an embodiment of an acoustic horn for use in the apparatus in accordance with the invention.

FIG. 7 is a perspective view showing an embodiment of an acoustic horn for use in the apparatus in accordance with the invention. In this embodiment the area of the opening 15 is smaller than the area of the diaphragm 21. Moreover, the opening 15 is elongate with an aspect ratio of approximately 1:4. This shape makes the acoustic horn very suitable for use in apparatuses in accordance with the invention in which only a marrow strip of the housing 3 is available for radiating sound. It has been found that with this embodiment the sound quality and the sound volume of a loudspeaker with a large diaphragm area can be approached while only a comparatively small area in the housing wall is required to radiate the sound.

It is to be noted that the invention is not limited to the exemplary embodiments shown herein. Various alternative embodiments are possible within the scope of the invention. For example, a flat diaphragm may be used instead of a conical diaphragm 21. It is also possible to arrange the magnet system 27 at the inner side of the cone 21 but outside the acoustic duct 11, the obstacle in the acoustic duct then being formed by the coil former 29 only. Instead of a stepped profile 17 it is also possible to provide a single upright wall at the location of the centre of the diaphragm 21. Besides, it is also possible to use other drive mechanisms which are known per se, for example mechanisms based on a piezoelectric or an electrostatic principle.

We claim:

1. An apparatus for the reproduction of sound, said apparatus comprising: a housing which accommodates an acoustic horn, wherein the horn has an acoustic duct having a length (L), wherein the duct is bounded by a horn side wall and terminates in an opening in a side wall of said housing, wherein the horn side wall is partly formed by a diaphragm which is drivable by a drive mechanism, said apparatus further comprising an obstacle disposed in the duct near a central part of the diaphragm, the duct having a cross-section (A—A) with an area (S) which as a function of a distance (d) from the opening is represented by a curve having a local minimum at the location of said obstacle.

2. The apparatus as claimed in claim 1, wherein said obstacle is formed by a stepped profile in the horn side wall.

3. The apparatus as claimed in claim 1, wherein said obstacle is formed by at least a part of the drive mechanism.

4. The apparatus as claimed in claim 3, wherein the drive mechanism comprises a magnet system and a coil former, the magnet system is carried by a part of the horn side wall which faces the diaphragm, and the coil former extends in the acoustic duct between the magnet system and the diaphragm.

5. The apparatus as claimed in claim 1, further comprising a cone disposed in the duct near a central part of the diaphragm, wherein said cone is drivable by the drive mechanism.

6. The apparatus as claimed in claim 1, wherein the area of the opening is smaller than the area of the diaphragm, and further wherein the opening is elongate.

7. The apparatus as claimed in claim 1, wherein the diaphragm forms at least a quarter of the area of the horn side wall.

8. The apparatus as claimed in claim 1, wherein said apparatus further comprises a picture tube near the horn, and the drive mechanism comprises a magnet system with an air gap, wherein the air gap is situated at the side of the magnet system which is remote from the picture tube.

9. An acoustic horn comprising:

an acoustic duct, said duct being bounded by a horn side wall, and having an opening, wherein the horn side wall is partly formed by a diaphragm which is drivable by a drive mechanism, characterized in that an obstacle is disposed in the duct near a central part of the diaphragm;

further characterized in that the duct has a cross-section with an area which, as a function of the distance from the opening of the duct, has a local minimum at the location of said obstacle.

* * * * *